US012495886B1

(12) United States Patent
Prax

(10) Patent No.: US 12,495,886 B1
(45) Date of Patent: Dec. 16, 2025

(54) LIQUID RESERVOIR SYSTEM

(71) Applicant: Xavier Prax, Willoughby Hills, OH (US)

(72) Inventor: Xavier Prax, Willoughby Hills, OH (US)

( * ) Notice: Subject to any disclaimer, the term of this patent is extended or adjusted under 35 U.S.C. 154(b) by 0 days.

(21) Appl. No.: 19/257,464

(22) Filed: Jul. 2, 2025

(51) Int. Cl.

| | |
|---|---|
| ***A45F 3/20*** | (2006.01) |
| ***B65D 75/00*** | (2006.01) |
| ***B65D 75/26*** | (2006.01) |
| ***B65D 75/56*** | (2006.01) |
| ***B65D 75/58*** | (2006.01) |
| ***B65D 81/30*** | (2006.01) |

(52) U.S. Cl.
CPC ..... *A45F 3/20* (2013.01); *B65D 75/008* (2013.01); *B65D 75/26* (2013.01); *B65D 75/563* (2013.01); *B65D 75/5883* (2013.01); *B65D 81/30* (2013.01); *B65D 2575/586* (2013.01)

(58) Field of Classification Search
CPC ..... A45F 3/20; B65D 75/008; B65D 75/26; B65D 75/563; B65D 75/5883; B65D 81/30; B65D 2575/586
See application file for complete search history.

(56) References Cited

U.S. PATENT DOCUMENTS 3,380,646 A * 4/1968 Doyen ..... B29C 66/431 493/203
3,784,085 A * 1/1974 Kilgore ..... B32B 29/02 383/105
4,320,789 A * 3/1982 Martin ..... A61J 1/10 383/906
4,458,811 A * 7/1984 Wilkinson ..... B29C 66/1122 206/219
4,484,351 A * 11/1984 de Leeuwe ..... G03F 7/16 222/107
RE32,065 E * 1/1986 Ralston, Jr. ..... A61J 1/05 604/408
5,996,845 A * 12/1999 Chan ..... B65D 77/2068 222/212
6,200,300 B1 * 3/2001 Petriekis ..... B65D 75/5877 604/408
6,662,829 B2 * 12/2003 Credle, Jr. ..... B65D 75/5877 141/10
6,679,304 B1 * 1/2004 Vacca ..... B65D 75/5883 141/2

(Continued)

FOREIGN PATENT DOCUMENTS

DE 202015009887 U1 * 1/2021 ..... B65D 75/54
EP 3594144 A1 * 1/2020 ..... B65D 75/5827

(Continued)

*Primary Examiner* — Frederick C Nicolas
(74) *Attorney, Agent, or Firm* — Invention To Patent Services; Alex Hobson

(57) ABSTRACT

A liquid reservoir system includes a flexible pouch with a spout and a hanger aperture configured to enable the spout to dispense substantially all of the liquid from the interior of the flexible pouch when hung vertically or horizontally from the hanger aperture. The flexible pouch including high-barrier layers and ultraviolet light blocking layers. The system may also include an auxiliary hose configured to detachable attach to the spout and extend to an oral interface to enable drinking from the pouch with the pouch retainer in an auxiliary location, such as in a saddle bag of a bicycle.

17 Claims, 5 Drawing Sheets

(56) References Cited

U.S. PATENT DOCUMENTS 6,776,307 B1 * 8/2004 Hagihara ..... B65D 75/5883 222/107
6,854,888 B1 * 2/2005 Brown ..... A45F 3/20 383/41
8,007,174 B2 * 8/2011 Yamaguchi ..... B65D 75/5805 383/41
8,083,105 B2 * 12/2011 Reichert ..... A45F 3/20 383/906
8,275,785 B2 * 9/2012 Krause ..... G09B 17/04 707/765
9,598,215 B2 * 3/2017 Araki ..... B65D 75/30
10,189,621 B2 * 1/2019 Dayrit ..... B32B 27/08
10,829,286 B2 * 11/2020 Murray ..... B65B 7/168
11,014,323 B2 * 5/2021 Daering ..... B31B 70/64
11,420,796 B2 * 8/2022 Koesters ..... B65D 33/004
11,691,799 B2 * 7/2023 Digonnet ..... B65D 77/065 222/105
2004/0079764 A1 * 4/2004 Balz ..... B65D 75/008 222/105
2005/0208240 A1 * 9/2005 Manabe ..... B32B 27/08 428/35.2
2007/0211967 A1 * 9/2007 Murray ..... B65B 3/045 383/207
2007/0217717 A1 * 9/2007 Murray ..... B65D 33/14 383/38
2008/0124006 A1 * 5/2008 Yamaguchi ..... A61J 1/10 383/66
2008/0226200 A1 * 9/2008 Murray ..... B65D 75/5811 383/7
2008/0233252 A1 * 9/2008 Manning ..... B65D 33/2508 426/106
2009/0116768 A1 * 5/2009 Huerta ..... B32B 27/308 383/207
2012/0008884 A1 * 1/2012 Murray ..... B65D 75/5805 383/104
2014/0185965 A1 * 7/2014 Lyzenga ..... B65B 9/2056 383/99
2014/0270577 A1 * 9/2014 Murray ..... B65D 31/02 383/5
2015/0274392 A1 * 10/2015 Pease ..... B65D 75/48 493/243
2015/0360839 A1 * 12/2015 Murray ..... B65D 75/008 383/7
2016/0031720 A1 * 2/2016 May ..... C02F 1/002 210/244
2016/0083145 A1 * 3/2016 Murray ..... B31B 70/60 493/379
2016/0137377 A1 * 5/2016 Tracy ..... B65D 75/5866 383/207
2016/0257082 A1 * 9/2016 Ragan ..... B65D 35/10
2017/0144800 A1 * 5/2017 Lucchese ..... B65D 75/566
2017/0208797 A1 * 7/2017 Murray ..... A01N 65/16
2021/0354895 A1 * 11/2021 Crosby ..... B65D 75/5877
2021/0401154 A1 * 12/2021 Bouhnik ..... A45F 3/20
2021/0401155 A1 * 12/2021 Bouhnik ..... A45F 3/20
2022/0250821 A1 * 8/2022 Takano ..... B65D 75/5877
2023/0174282 A1 * 6/2023 Takano ..... B65D 75/26 383/3
2023/0391526 A1 * 12/2023 Mori ..... B32B 27/08
2023/0391528 A1 * 12/2023 Mori ..... B29C 66/83221
2024/0351749 A1 * 10/2024 Watabe ..... B65D 33/08
2024/0409293 A1 * 12/2024 Tanaka ..... B65D 75/5883
2025/0066091 A1 * 2/2025 Moreno Brociner .. B65D 55/16
2025/0197069 A1 * 6/2025 Brulz ..... B65D 83/06
2025/0206504 A1 * 6/2025 Tanaka ..... B65D 75/56
2025/0241425 A1 * 7/2025 Bauer ..... A61Q 5/10

FOREIGN PATENT DOCUMENTS

GB 2561602 A * 10/2018 ..... B65D 75/566
WO WO-2010048764 A1 * 5/2010 ..... B65D 75/5883
WO WO-2016201492 A1 * 12/2016 ..... B65D 75/008

* cited by examiner

LIQUID RESERVOIR SYSTEM

BACKGROUND OF THE INVENTION

Field of the Invention

The invention relates to a liquid reservoir system that includes a flexible pouch with a spout configured to fully dispense liquid when hung either vertically or horizontally from a hander aperture configured opposite the funnel portion of the flexible pouch.

Background

There are a number of hydration systems that include a portable hydration reservoir for single-use. Currently, reusable sport and activity water bottles and hydration bladders are popular, environmentally friendly alternatives to single-use plastic containers. However, it is crucial to understand the potential health risks associated with their use if proper hygiene is not maintained. The enclosed and often moist environment within reusable water bottles and hydration bladders provides an ideal breeding ground for bacteria and mold. This microbial growth can lead to various adverse health effects, including digestive disturbances, respiratory issues, and allergic reactions. Several factors contribute to this contamination, including warmth, humidity, and the formation of resilient biofilm. Hydration bladders are more susceptible to bacteria and mold due to their complex designs, making effective cleaning challenging.

Recent research has also highlighted the presence of micro-nanoplastics, fragments of plastic material that can leach into contained drinking fluids. While the leaching properties depend heavily on the specific plastic type and additives, the use of an opaque flexible film in reusable hydration devices offers potential benefits by blocking ultraviolet (UV) light, which may reduce the degradation of the plastic material caused by UV exposure, thereby minimizing the leaching of plastic components into the stored liquid.

Existing packaging solutions often present various limitations for storing and dispensing consumable liquids. For instance, U.S. Patent No. U.S. Pat. No. 11,014,323B2 to Daering et al., titled "Stand Up Pouch With Fitment," focuses on an improved method for manufacturing generic flexible pouches with fitments by optimizing sealant application for cost and efficiency. Other similar patented innovations, such as the U.S. Pat. No. 3,380,646 to Doyen et al, titled "Container Of Plastic Material and Method Of Producing Same" introduced the concept of a flexible container made from plastic material that could stand upright on its own, offering significant advantages over traditional rigid containers, but typically without an integrated drink spout.

U.S. Pat. No. 10,829,286 B2 to Murray et al, titled "SPOUTED POUCH ADAPTED TO BE FILLED WITH A FLOWABLE PRODUCT AND METHOD OF PRODUCTION THEREOF," also primarily focuses on the manufacturing process of generic stand-up pouches with fitments, emphasizing cost-effective and precise sealant application. Similarly, United States Patent Application Publication No. US 2008/0203105 A1, published Aug. 28, 2008, to Trotman et al., describes a packaging sleeve for a beverage pouch. This patent family focuses on providing a sleeve for a flexible pouch, often at the point of sale, with an emphasis on issues such as efficient storage, reducing waste, handling hot or cold beverages, and creating a visual "theatre" during dispensing.

Furthermore, Taiwanese Patent M636710U, published Jan. 21, 2023, by Zheng Quanlin et al., and titled "Frozen Tapioca Ball Beverage Pack" discloses a method for rapidly freezing cooked tapioca balls within a beverage in a sealed soft packaging bag. This patent centers on preserving tapioca texture and enabling frozen storage and retail of this specific dessert product.

While these prior art references address aspects of flexible pouches, fitment insertion, or even freezing specific beverage types, they do not collectively or individually contemplate a comprehensive hydration system that specifically addresses the needs of a pre-freezable, light-protective, disposable reservoir for high-purity hydration. They fail to address the unique challenges of ensuring beverage purity, offering sustained cold hydration through controlled thawing, or optimizing gravity-fed dispensing across multiple orientations in a system designed to mitigate plastic leaching and enhance consumer health for active users.

SUMMARY OF THE INVENTION

The present invention provides a liquid reservoir system including a flexible pouch with a spout engineered to store and dispense consumable liquids effectively and sustainably. The system may be designed to be disposable, or for single-use, and include a flexible pouch that may be opaque with a specifically configured spout for containing and dispensing fluids therefrom, including, but not limited to, water, sports energy drinks, fruit drinks, tea and the like. The orientation of the spout and the hanger aperture enable the spout to dispense substantially all of the liquid (at least 90% and preferably at least 95%) from the interior of the flexible pouch when the flexible pouch is hung vertically or horizontally from the hanger aperture.

To ensure the highest standard of portable and accessible hydration for human consumption during any recreational or sporting activity, the liquid reservoir system offers a demonstrably safer and optimal hygienic solution.

The flexible pouch of the liquid reservoir is formed by a first panel and second panel of material, that includes a polymeric material, that is sealed along the perimeter to form a seal, such as a hermetic seal to prevent liquid from leaking from the flexible pouch. Also, a spout is coupled with the flexible pouch and extend from the pouch to enable fluid flow of the fluid inside the interior of the flexible pouch out through the spout. The spout is also sealed with the first panel and the second panel along a spout extension portion of the perimeter of the flexible pouch, or seal.

The flexible pouch has a spout end, and a gusseted end, opposite the spout end. The flexible pouch also has a long side and a short side opposite the long side, wherein the long side or seal along the long side extends along a length axis of the flexible pouch. The flexible pouch may be rectangular in shape with the long side being longer than the spout end or gusseted end. The spout extension extends from the spout end to the short side at a funnel angle from the spout end of about 135 degrees, or from about 110 degrees to about 150 degrees. The spout may extend along a spout axis that is orthogonal to the spout extension, wherein the spout axis extends a spout angle from the spout end of about 45 degrees, or from about 30 degrees to about 50 degrees. This arrangement of the angled spout extension between the spout end and the short side produces the funnel portion, a tapering portion of the interior of the flexible pouch.

A hanger aperture is configured in the opposite the spout on the flexible pouch, or between the long side and gusset side of the flexible pouch, such as in the seal or outside of the seal from the interior, that extends between the long side and gusset side. This hanger aperture along with the spout extension configured at a spout angle enables liquid within the flexible pouch to be dispensed fully due to the being configured most distal from the hanger aperture with the liquid reservoir hung either vertically or horizontally from the hanger aperture. Put another way, the spout opening may be the most offset vertically from the hanger aperture with the liquid reservoir hung either horizontally or vertically from the hanger apertures.

The first panel and/or the second panel of the flexible pouch may be made of materials to ensure safe consumption of a beverage therefrom. The panel may include a food grade interior layer or material to ensure that there is on contamination of the liquid retainer within the flexible pouch. The panel may also include a barrier layer, such as a barrier film or chemical to prevent permeation through the panel and into the liquid within the liquid reservoir. Also, the panel may include an intermediate barrier layer which may include an ultraviolet light (UV) barrier that may absorb or otherwise prevent UV light from passing through the panel. The UV barrier may also be included in one of the other layers, the food grade interior layer and/or the exterior barrier layer.

A flexible pouch of the liquid reservoir may be hermetically sealed to retain a consumable liquid beverage within liquid reservoir, allowing the beverage to be post-refrigerated, chilled, semi-slush frozen, or fully frozen. This feature is particularly beneficial for outdoor activities like hiking and biking, as it enables a range of specific hydration needs, from immediate room temperature consumption to a slow-release cold source through a unique freeze-to-thaw functionality. The interchangeable pouches are designed for seamless integration with a versatile pouch hosting and liquid delivery system, supporting both vertical and horizontal orientations for controlled, gravity-fed drinkability.

Furthermore, the first panel and/or the second panel of the flexible pouch may be opaque, which offers significant advantages by blocking external light, which reduces plastic leaching and significantly improves the beverage's integrity and shelf life. This design ultimately contributes to enhanced consumer health by maintaining the purity of the stored liquids.

The liquid reservoir may be a disposable liquid reservoir wherein the spout is not configured for the flexible pouch to be refilled. Also, the disposable liquid reservoir may be made of plastic panels that are inexpensive to enable the liquid reservoir to be disposable.

The liquid reservoir system may also include an auxiliary hose assembly that is configured to detachably attach with the spout. The spout may include spout threads and a spout coupler of the auxiliary hose assembly may include mating threads, wherein the spout threads may be male threads and the coupler threads may be female threads, or vice versa. The auxiliary hose assembly includes an auxiliary hose that extends a length from the spout to enable deliver of the liquid from the liquid reservoir an offset distance. This length may be about 25 cm or more, about 50 cm or more, about 75 cm or more, or even about 1m or more or from about 25 cm to 1m and any other range between and including the values provided. A length of the auxiliary hose may enable a flexible pouch to be configured under the seat of a bicycle and the auxiliary hose may extend from the flexible pouch to enable the bicycle rider to drink while cycling. The auxiliary hose assembly may also include a valve that may be opened manually to allow liquid to flow through the auxiliary hose or closed to prevent liquid from flowing through the auxiliary hose. The valve may be configured along the length of the hose, or proximal to the spout coupler or proximal the extended end of the auxiliary hose. An oral interface may be configured on the extended end of the auxiliary hose, such as a mouthpiece, which may be a bite valve type mouth piece that includes a bite valve that opens when the mouthpiece is compresses by biting and closes automatically when released from this compression. Also, the auxiliary hose assembly may include a hanger clip, a clip to retain the auxiliary hose in a desired location, such as on a strap of a backpack or on a person's shirt, etc.

In some embodiments, a method for promoting human physiological well-being is provided, comprising the oral ingestion of cold water under specific circumstances. Such circumstances may include, but are not limited to, periods of elevated ambient temperature coupled with physical exertion, which leads to increased perspiration rates. In these instances, consuming cold water aids efficient rehydration by encouraging greater fluid intake and may be the optimal temperature for restoring fluid balance. Furthermore, ingesting cold water can enhance or maintain alertness, as it may stimulate the natural production of adrenaline in the body, providing an invigorating effect without the common side effects associated with caffeine. Additionally, during physical exercise, the intake of cold water can help regulate core body temperature and heart rate, thereby sustaining energy levels and enabling longer periods of activity. The beneficial effects of cold water consumption described herein may vary based on individual physiological factors, including health status, age, and the volume of water consumed.

In some embodiments, a method for improving human health is provided, comprising the step of orally ingesting room temperature water. This ingestion may offer several health advantages, including a metabolism boost, particularly when consumed upon waking, and can assist in weight management, especially when combined with honey. Furthermore, room temperature water consumption can stimulate the digestive system, promoting regular bowel movements and alleviating constipation by aiding in the breakdown of dietary fats. The ingestion of room temperature water is also beneficial for respiratory health, as it can help clear nasal and sinus congestion by thinning and removing mucus from the respiratory tract, thereby improving breathing and reducing throat irritation, and may provide relief from symptoms associated with allergies, colds, or flu. Additionally, consuming room temperature water, particularly before bedtime, can enhance sleep quality and cognitive function. For women experiencing menstrual cramps, the ingestion of room temperature water can have a soothing effect on the muscles of the abdomen, thereby easing pain and promoting more restful sleep. It is understood that the specific effects of drinking room temperature water may vary among individuals depending on factors such as overall health, age, and the quantity consumed The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
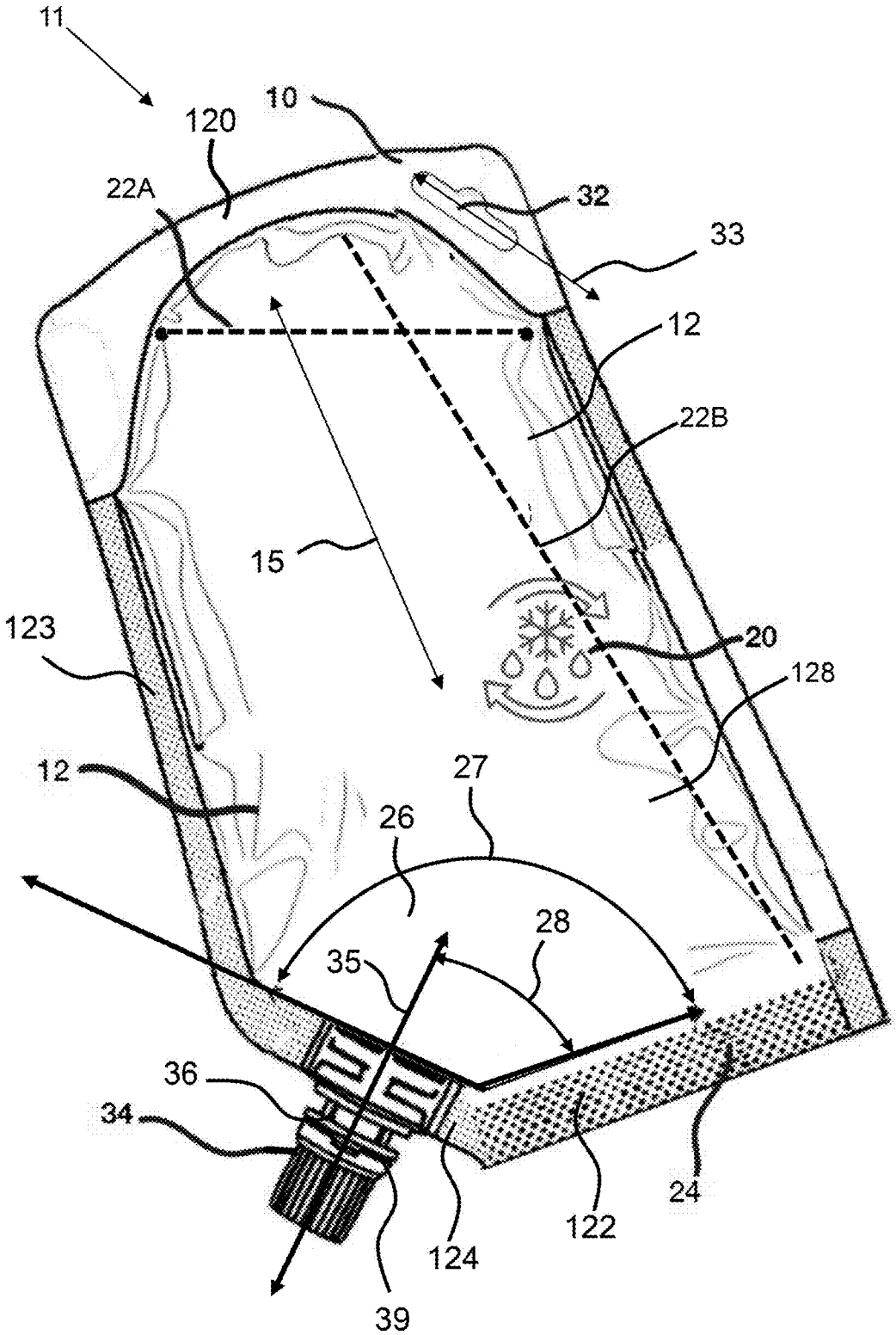
FIG. 1 shows a perspective view of the liquid reservoir of a liquid reservoir system positioned in a vertical use position.

Corresponding reference characters indicate corresponding parts throughout the several views of the figures. The figures represent an illustration of some of the embodiments of the present invention and are not to be construed as limiting the scope of the invention in any manner. Some of the figures may not show all of the features and components of the invention for ease of illustration, but it is to be understood that where possible, features and components from one figure may be included in the other figures. Further, the figures are not necessarily to scale, some features may be exaggerated to show details of particular components. Therefore, specific structural and functional details disclosed herein are not to be interpreted as limiting, but merely as a representative basis for teaching one skilled in the art to employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

The present invention provides a liquid reservoir system 11 that includes a liquid reservoir 10 that may be configured for single use and engineered for superior versatility and functionality across diverse applications. This liquid reservoir 10is designed to significantly enhance user convenience and expand utility in both athletic and medical contexts, accommodating frozen or unfrozen hydration fluids.

Figure 2:
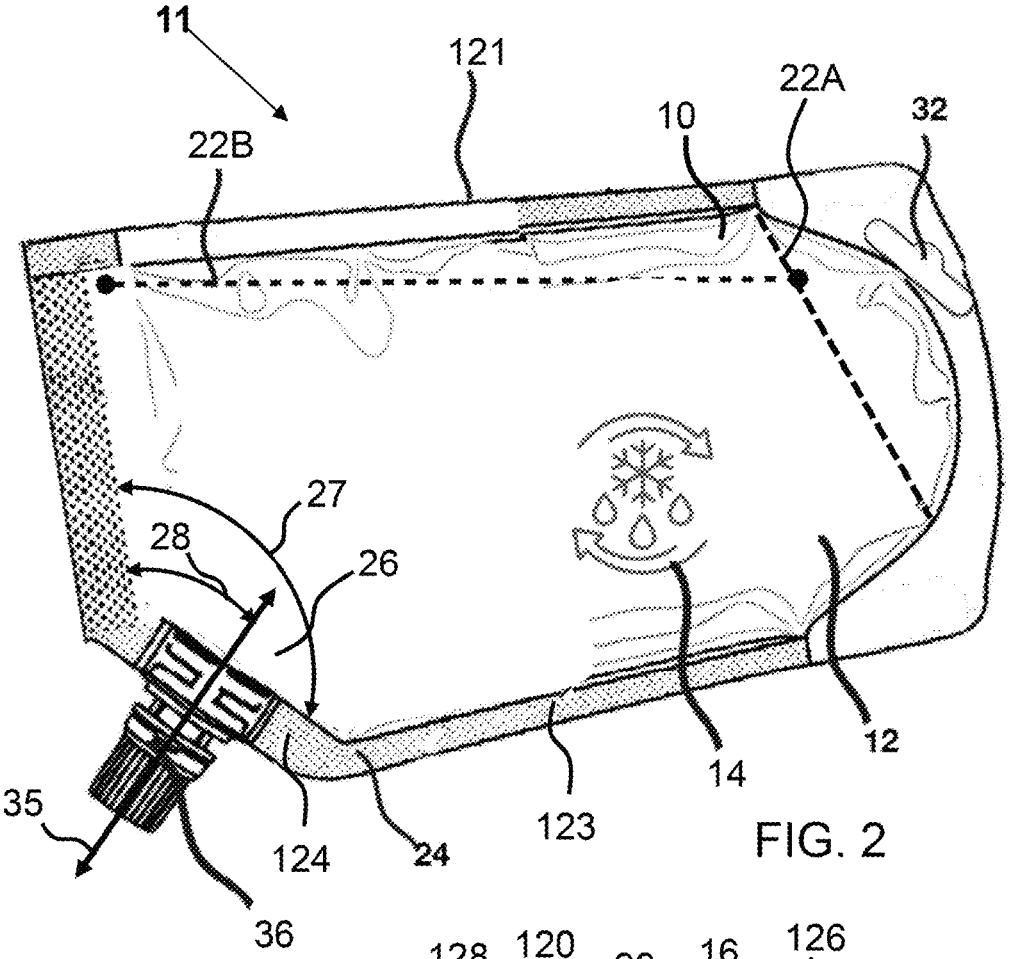
FIG. 2 is a perspective view of the liquid reservoir positioned in a horizontal use position.
Figure 3:
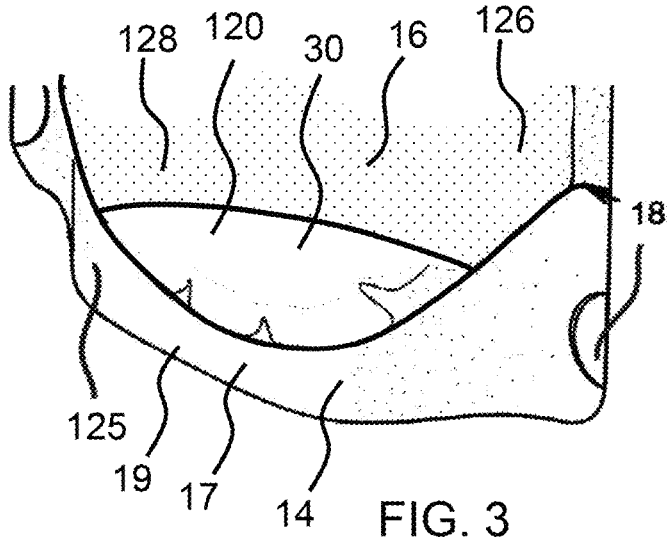
FIG. 3 cut-away view of the flexile pouch of the liquid reservoir system with the gusset panel expanded.

Referring now to FIGS. 1 to 3, the liquid reservoir 10 may be oriented vertically as shown in FIG. 1 or horizontally as shown in FIG. 2. As shown in FIG. 1, the liquid reservoir 10 is oriented vertically with the spout 36 extending along the spout axis 35 from the funnel portion 26 of the flexible pouch 12. The funnel portion 26 is a tapering portion of the interior of the flexible pouch 12 between the spout end 122 and the short side 123. The spout 36 extend from the spout extension 124 of the flexible pouch and the spout extension extends at a funnel angle 27 from the spout end 122 of the flexible pouch 12. The flexible pouch also has a pair of opposing sides, a long side 121 and a short side 123. A gusseted end 120 is opposite the spout end 122 and is configured with a gusset panel 30, as shown in FIG. 3, to enable the flexible pouch to expand to enable the flexible pouch to stand upright on this gusseted end 120 with the gusset panel 30 extending and expanded between the first panel 125 and second panel 126. The flexible pouch has a hanger aperture 32 configured across from the spout 36 and along the corner or edge between the long side 121 and the gusseted end 120.

A pair of maximum fill lines 22A, 22B are printed on the flexible pouch 12 to indicate the maximum liquid volume to accommodate the freezing of a liquid filed therein. These maximum fill lines prevent freezing liquid from bursting the flexible pouch along the seams. Maximum fill line 22A extends proximal to the gusseted end or from the long side 121 toward the short side 123 and maximum fill line 22B extends long the long side 121 or from the gusseted end 120 toward the spout end 122. Maximum fill line 22A indicates the maximum fill of the interior of the flexible pouch 12 when hung vertically from the hanger aperture 32, as shown in FIG. 1 and maximum fill line 22B indicates the maximum fill when the flexible pouch is hung horizontally from the hanger aperture 32 as shown in FIG. 2. The liquid reservoir 10 is designed to host a fluid fill range of 16 ounces or more, about 24 ounces, about 32 fluid ounces or more of consumable drinking fluids, and any range between and including the volumes provided.

The flexible pouch 12 is formed by a first panel 125 and second panel 126 that are sealed together to form a seal 24, such as a hermetic seal, that may be formed by thermally bonding the two layers together. The seal may extend around the spout.

The spout 36 extends out from the spout extension 124 along the spout axis 35 that is a spout angle 28 from the spout end 122. This spout angle may be about 30° or more, about 40° or more, about 45° or more, about 50° or more, or about 60° or less and any range between and including the angles provided. It is preferred that the spout angle be about 45° to enable full evacuation of the liquid from the interior 128 of the flexible pouch 12 when the flexible pouch is suspended from the hanger aperture 32. The spout extension 124 extends at a funnel angle 27 from the spout end 122 and this angle may be about 110° or more about 120° or more, about 130° or more, about 140° or more, about 150° or more, or about 160° or less and any range between and including the angles provided. It is preferred that the funnel angle be about 135° to enable full evacuation of the liquid from the interior 128 of the flexible pouch 12 when the flexible pouch is suspended from the hanger aperture 32.

As shown in FIG. 2, the flexible pouch 12 of the liquid reservoir 10 is hung from the hanger aperture 32 and extends horizontally.

As shown in FIG. 3, the flexible pouch is flexible, including a polymeric film 19. The first panel 125 and/or second panel 126 of the flexible pouch 12 may be a composite material 20, such as a laminate, and may include a high-barrier film layer 14, which may be on an exterior of the panel, a food grade interior layer 16 configured along the interior of the panel and may include an intermediate layer 18. The high-barrier film layer may inhibit the permeation of gases, such as moisture and oxygen and may also block ultraviolet (UV) rays through the flexible pouch 12. A UV blocking layer 17 may be included in the panels, such as with the high-barrier film layer 14, the food-grade interior layer and/or the intermediate layer and may prevent UV light from passing through the panel into the interior of the flexible pouch. Note that a UV blocker layer may not block all the UV light but preferably the UV blocking layer blocks a substantial amount of UV light from passing through, such as at least 90%. A food-grade interior layer 16 may be made of a material that is accepted for food contact and/or food storage. The intermediate layer may also be a barrier layer and may include a UV stabilizer or UV blocking chemical or film.

This intermediate barrier layer may include a polymer selected from the group consisting of polyethylene (PE), polypropylene (PP), polystyrene (PS), and polyethylene terephthalate (PET). The liquid reservoir 10 is specifically designed to safely accommodate a complete range of hydration fluids. The intermediate layer may include a UV barrier material or film or may include a high-barrier layer that prevents permeation.

The liquid within the flexible pouch 12 may range from room temperature which is typically around 20-22° C. (68-72° F.), which is neither too cold nor too hot, allowing for easy absorption and rehydration. The liquid within the flexible pouch may be frozen thereby enabling hydration as the frozen liquid thaws. The construction of the flexible pouch may be engineered to safely accommodate and facilitate the thawing of frozen contents into a liquid state. This ensures a controlled and gradual release of cold hydration. When packaging liquids or high-water content substances for freezing, it is critical to account for volume expansion during freezing and thawing. Water expands by approximately 9% when it freezes, a phenomenon that can lead to container rupture if insufficient headspace is provided. To accommodate this expansion, the maximum fill line which may be printed on the flexible pouch, indicates a 9% volume over the fill volume of the flexible pouch for freeze expansion allowance. This maximum fill lines 22A, 22B are marked or on the liquid reservoir 10 that accounts for the approximate 9% expansion of water when it freezes, ensuring container integrity and preventing rupture during freezing. The fill lines may indicate a maximum fill with a freeze expansion volume remaining, which may be about 15% volume or less, about 12% volume or less, about 10% volume of less and at least 9% volume, and any range between and including the values provided.

For example, a 16-ounce volume will expand by approximately 1.44 ounces (16 oz*0.09), resulting in a total frozen volume of 17.44 ounces. Similarly, a 24-ounce volume will expand by about 2.16 ounces, and a 32-ounce volume by about 2.88 ounces. Therefore, it is imperative to leave a minimum empty volume equivalent to at least 9% of the initial fill to prevent material stress and ensure container integrity during the freezing process. This allows for a range of consumer preference choices for hydration applications, as some prefer the liquid reservoir 10 to include completely frozen liquid for a lengthy bike ride. This "freeze-to-hydrate" benefit ensures a slow melt for prolonged coldness, meaning the drink will likely remain cold for several hours. An estimated range for thawing frozen water in typical single-use pouches with an average outdoor temperature of 80 degrees Fahrenheit, not in direct sunlight, is as follows:

- 16 fl oz (approx. 0.5 L): Partially thawed (slushy, drinkable with some ice): 1.5-3 hours. Mostly liquid (minimal ice): 3-5 hours;
- 24 fl oz (approx. 0.7 L): Partially thawed (slushy, drinkable with some ice): 2-4 hours. Mostly liquid (minimal ice): 4-7 hours;
- 32 fl oz (approx. 1 L): Partially thawed (slushy, drinkable with some ice): 2.5-5 hours. Mostly liquid (minimal ice): 5-9 hours.

Controlled drinkability with gravity feed is maintained as the ice melts, allowing liquid water to settle to the bottom, thereby enabling gravity feeding even with significant ice remaining.

The liquid reservoir 10 may be constructed with an hermetically heat-sealed perimeter that extends around the perimeter of the flexible pouch. This seal ensures an airtight and leak-proof enclosure, maintaining beverage integrity.

To facilitate dispensing in various orientations, the liquid reservoir 10 includes a funnel portion 26. This funnel feature is strategically positioned diagonally a funnel angle 27 of about 135° from a spout end 122. The funnel portion and the spout extending along a spout angle are designed to direct liquid flow efficiently when the liquid reservoir 10 is hung vertically, effectively leveraging gravity.

Similarly, a funnel portion may funnel liquid out of the spout when the liquid reservoir 10 is hung horizontally, as shown in FIG. 2, again utilizing gravity for optimal dispensing. Both the vertical and horizontal suspension positions allow for the liquid reservoir 10 to have the spout 36, which may be include spout threads 39, affixed to the auxiliary hose assembly 44 for non-squeezing, hands-free utilization of the liquid reservoir 10.

For hanging, a hanger aperture (32) is provided that may be a slot that extends along a hanger axis 33 that is diagonal with respect to a length axis 15 of the flexible pouch. The length axis is parallel with the long side 121 of the flexible pouch. This hanger aperture, an opening or hole in the flexible pouch, may be along or in the seal 24 and is configured opposite the spout, or between the long side 121 and the gusseted end 120.

For fluid access and sealing, the liquid reservoir 10 incorporates a spout closure 34, such as a spout cap that may thread onto the spout 36. This spout closure, such as a cap, may include female threads that can be easily screwed on and off the spout which may include spout threads 39, male threads, allowing for repeated opening and closing of the liquid reservoir 10.

Figure 4:
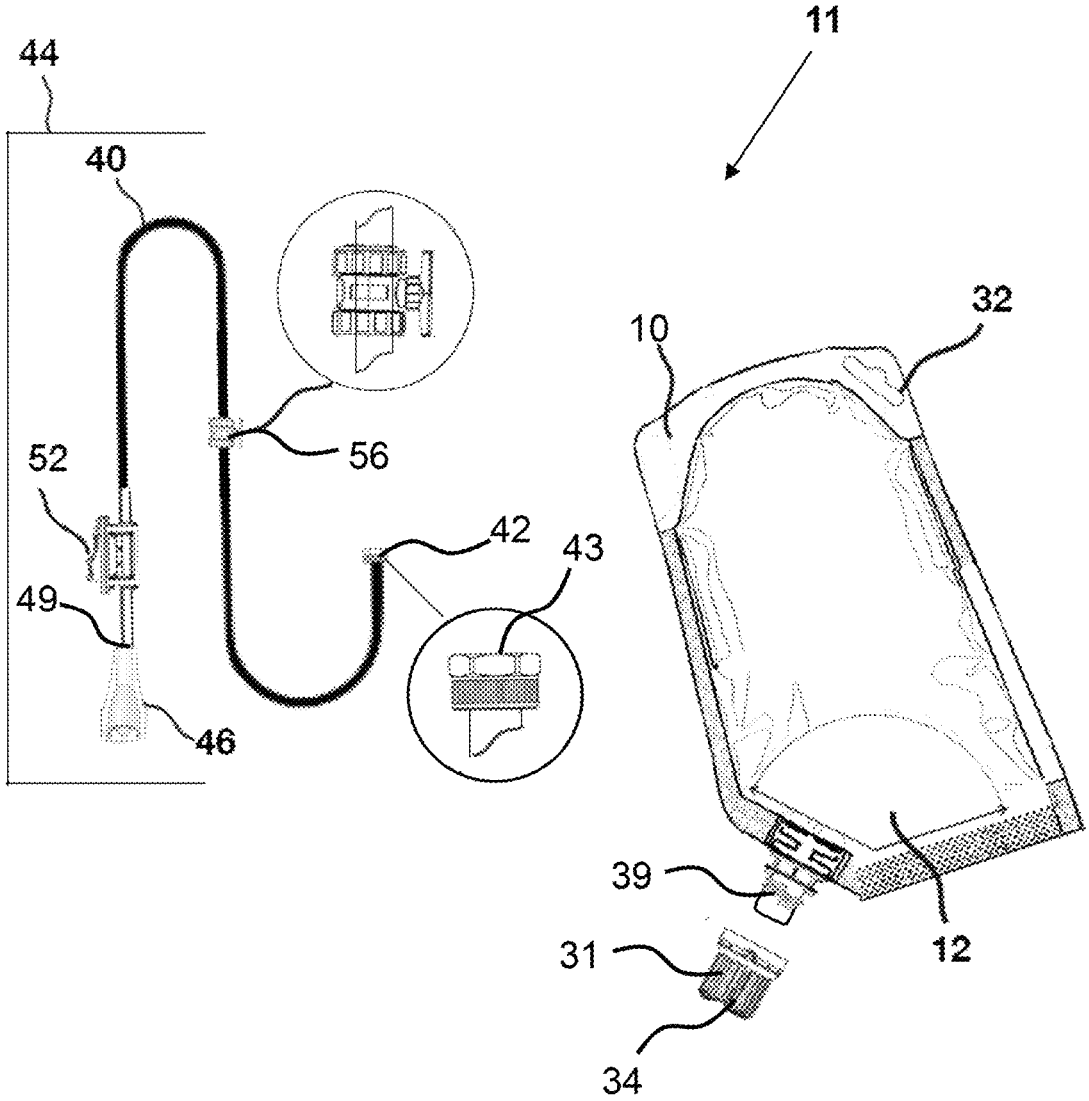
FIG. 4 shows the liquid reservoir system including an auxiliary hose assembly.
Figure 6:
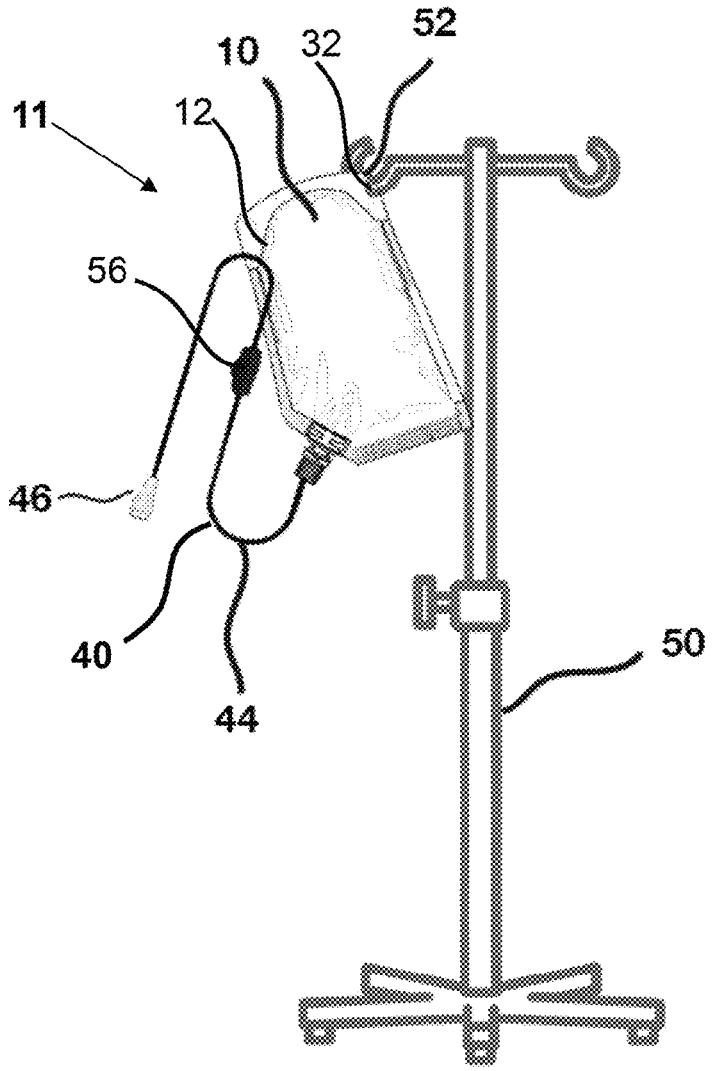
FIG. 6 shows the liquid reservoir system with the liquid reservoir in a vertical position in a drip stand, demonstrating an illustrative use case of the reservoir and oral hydration hose attached vertically.

Referring now to FIGS. 4 and 6, the liquid reservoir system may include an auxiliary hose assembly 44 that includes an auxiliary hose 40 and a spout coupler 42. The spout coupler 42 may have coupler threads 43 configured to engage with the spout threads 39, as shown in FIG. 4. Also, a spout cap 31, which may be a threaded spout cap may be configured to detachably attach onto the spout to seal off the interior of the flexible pouch from contamination. The auxiliary hose 40 may also be made of food-grade hose such as a flexible hose made from food-safe vinyl material, suitable for drinking therefrom. The auxiliary hose may have a length from the spout coupler 42 to an extended end 49 to facilitate hands-free drinking, greatly improving user experience during demanding physical activities. The length of the auxiliary hose may be about 25 cm or more, about 50 cm or more, about 75 cm or more, or even about 1m or more or from about 25 cm to 1m and any other range between and including the values provided. Imagine the ease of staying hydrated while running, biking, or motorcycle riding, without breaking stride or fumbling with bottles, and with the confidence that your chosen fluid, whether icy cold, simply chilled, or room temperature, maintains its desired temperature for longer. The auxiliary hose assembly 44 may also include a valve 56 coupled with the auxiliary hose to enable a flow of liquid from the liquid reservoir 10 to be initiated and then stopped. The valve may be actuating valve with a knob or button or may be a bite valve that is coupled proximal to an end or on the end of the auxiliary hose 40. The auxiliary hose assembly 44 may include an oral interface 46, a mouthpiece for example, that is configured for insertion into a person's mouth to enable them to drink through the auxiliary hose assembly 44. Again, the valve 56 may be a bite valve that is configured within the mouthpiece or oral interface 46. The auxiliary hose assembly components are optional and are detachably attachable to the liquid reservoir 10. The auxiliary hose assembly 44 may also include a hanger clip 52, that is configured to retain the auxiliary hose to a desired location or object, such as a backpack strap or to a collar or shirt. The hanger clip may be configured proximal to an extended end 49 of the auxiliary hose 40.

Figure 5:
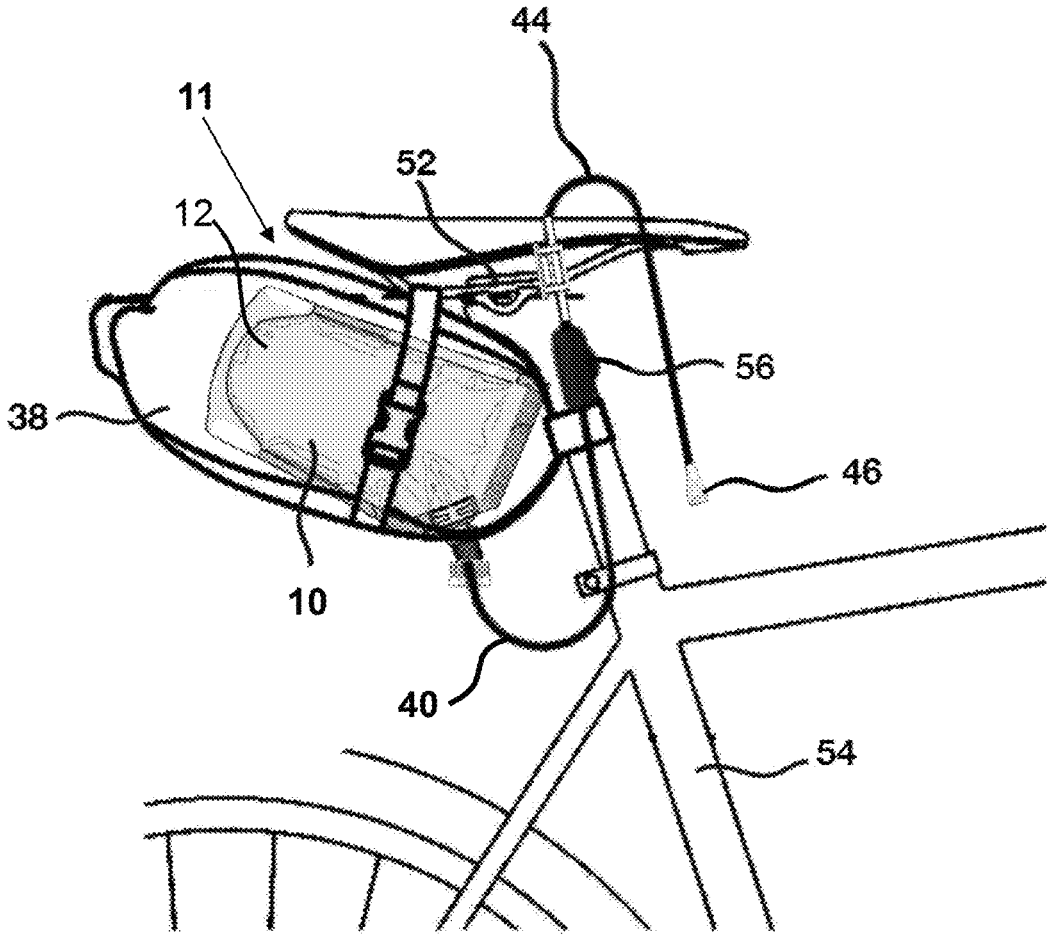
FIG. 5 shows the liquid reservoir system with the liquid reservoir configured horizontally on a bicycle with the auxiliary hose extending out from an auxiliary receptacle, a saddle bag.

As shown in FIG. 5, the liquid reservoir 10 is configured in an auxiliary receptacle 38, a saddle bag coupled to the saddle of the bicycle 54 by the handler clip 52. The saddle bag may be a container specifically designed to accommodate and support the primary liquid reservoir 10 for convenient hands-free use during activities.

As shown in FIG. 6, the liquid reservoir system 11 is coupled with a drip stand 50, by a hanger clip 52. The drip strand, or an intravenous (IV) pole, may enable a controlled drip, useful in various flow settings. The valve 56 may be set for a particle drip rate as required. This allows for the precise and non-spill delivery of solutions. This feature is particularly beneficial for medical bedside applications, enabling accurate patient hydration intake monitoring. This same practical application of IV pole-supported hydration can be adapted for the sports industry, with stationary hydration apparatuses strategically positioned within athletic seating or resting areas, providing athletes with convenient and monitored access to fluids, again with the flexibility to use either frozen or unfrozen solutions, incorporating the optimal "Oral Rehydration Therapy" (ORT). An auxiliary hose hosting hanger clip 52 is designed to hold or secure the auxiliary hose 40.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention covers the modifications, combinations and variations of this invention provided they come within the scope of the appended claims and their equivalents.

What is claimed is:

1. A liquid reservoir system comprising:

a) a liquid reservoir comprising:

i) a flexible pouch configured to contain a consumable liquid, said flexible pouch comprising:

a first panel and a second panel sealed together around a perimeter to form a seal;

a spout end;

a gusseted end opposite the spout end and comprising a gusset panel extending between the first panel and second panel to enable the flexible pouch to stand upright on the gusseted end;

a long side extending from the spout end to the gusseted end;

a short side extending from the spout end to the gusseted end opposite the long side;

a spout extension extending from the spout end to the short side at a funnel angle that is between 110 degrees and 150 degrees; and a hanger aperture configured between the long side and the gusseted end; and ii) a spout integrated with said flexible pouch, and coupled along the spout extension, said spout configured for dispensing said consumable liquid from the flexible pouch iii) a fill line extending from the long side toward the short side and proximal to the gusseted side to indicate a maximum fill volume of said liquid when the flexible pouch is configured vertically from the hanger aperture; and iv) a fill line extending from the spout end toward the gusseted end and proximal to the long side to indicate a maximum fill volume of said liquid when the flexible pouch is configured horizontally from the hanger aperture, and wherein each of said fill lines indicate a fill volume of the flexible pouch with a freeze expansion volume remaining between 9% and 15% volume.

2. The liquid reservoir system of claim 1, wherein the first panel and the second panel of the flexible pouch each comprises a food-grade interior layer.

3. The liquid reservoir system of claim 2, wherein the first panel and the second panel of the flexible pouch each comprises a high-barrier film layer configured to inhibit permeation of gases through the high-barrier film layer.

4. The liquid reservoir system of claim 3, wherein the first panel and the second panel of the flexible pouch each comprise a polymer film layer selected from the group consisting of polyethylene (PE), polypropylene (PP), polystyrene (PS), and polyethylene terephthalate (PET).

5. The liquid reservoir system of claim 4, wherein the first panel and the second panel of the flexible pouch each comprises an ultraviolet light blocking layer.

6. The liquid reservoir system of claim 4, wherein the ultraviolet light blocking layer blocks at least 90% of UV light.

7. The liquid reservoir system of claim 1, wherein the first panel and the second panel of the flexible pouch each comprises an ultraviolet light blocking layer.

8. The liquid reservoir system of claim 7, wherein the ultraviolet light blocking layer blocks at least 90% of UV light.

9. The liquid reservoir system of claim 1, wherein the flexible pouch further comprises a polymer film layer selected from the group consisting of polyethylene (PE), polypropylene (PP), polystyrene (PS), and polyethylene terephthalate (PET).

10. The liquid reservoir system of claim 1, wherein said spout includes spout threads.

11. The liquid reservoir system of claim 1, further comprising a spout cap having female threads and wherein the spout threads are male threads to enable the spout cap to detachably attach to the spout.

12. The liquid reservoir system of claim 1, wherein the seal is a hermetic seal.

13. The liquid reservoir system of claim 1, further comprising an auxiliary hose system comprising:

a) an auxiliary hose that extends a length from a coupler spout coupler to an extended end; and b) said spout coupler that is detachably attachable to the spout.

14. The liquid reservoir system of claim 13, wherein the spout coupler comprises coupler threads and wherein the spout comprises spout threads that are configured to engage with the coupler threads to detachably attach the spout coupler to the spout.

15. The liquid reservoir system of claim 14, wherein the auxiliary hose system further comprises a valve.

16. The liquid reservoir system of claim 13, wherein the auxiliary hose system further comprises an oral interface.

17. The liquid reservoir system of claim 16, wherein the oral interface comprises a bite valve.

* * * * *